United States Patent [19]

Olsen et al.

[11] Patent Number: 4,834,014

[45] Date of Patent: May 30, 1989

[54] FLOATING PLATFORM STRUCTURE

[75] Inventors: Fred Olsen, Biskop Grimelunds vei 21, N-0374 Oslo 3; Birger J. Natvig, Haslum, both of Norway

[73] Assignee: Fred Olsen, Oslo, Norway

[21] Appl. No.: 26,958

[22] Filed: Mar. 17, 1987

[51] Int. Cl.[4] ..... B63B 35/44

[52] U.S. Cl. ..... 114/265; 114/266; 114/267

[58] Field of Search ..... 114/263–267, 114/258; 405/208, 195, 224, 203, 207, 200, 218, 219

[56] References Cited

U.S. PATENT DOCUMENTS

| | | | |
|---|---|---|---|
| 3,830,176 | 8/1974 | Arita | 114/265 |
| 3,837,309 | 9/1974 | Biewer | 114/265 |
| 3,841,249 | 10/1974 | Vilain | 114/265 |
| 3,986,471 | 10/1976 | Haselton | 114/265 |
| 3,996,755 | 12/1976 | Kalinowski | 114/265 |
| 4,286,538 | 9/1981 | Matsui | 114/267 |
| 4,516,882 | 5/1985 | Brewer | 114/265 |
| 4,556,008 | 12/1985 | Copson | 114/265 |
| 4,582,014 | 4/1985 | Patel | 114/265 |
| 4,646,672 | 3/1987 | Bennett | 114/265 |

*Primary Examiner*—Joseph F. Peters, Jr.
*Assistant Examiner*—Clifford T. Bartz
*Attorney, Agent, or Firm*—Hedman, Gibson, Costigan & Hoare

[57] ABSTRACT

A buoyant support unit and platform employing the same which includes at least five substantially cylindrical floatable pipes having a diameter of less than about 5 meters which are arranged parallel to each other in spaced-apart relationship, wherein the edge to edge distance between adjacent pipes is from 0.25 to 2.0 times the diameter of the pipe.

22 Claims, 3 Drawing Sheets

FLOATING PLATFORM STRUCTURE

FIELD OF THE INVENTION

The present invention relates to an arrangement in a supporting buoyancy unit, preferably for semi-submersible platforms for exploiting natural offshore resources, comprising a hollow buoyancy element generally made of steel, with larger horizontal than vertical dimesions and optionally at least one column extending upwards therefrom for supporting a deck structure or the like.

BACKGROUND OF THE INVENTION

Semi-submersible platforms are known in various embodiments. The most common one has two buoyancy elements in the form of parallel pontoons from which a plurality of columns extend to support the deck structure of the platform. Reinforcing stays or trusses are usually arranged in planes extending transversally of the longitudinal direction of the pontoons. Another type of semi-submersible platform has a somewhat higher number of buoyancy elements, usually five or six, which are arranged in the cornes of a corresponding polygon. These buoyancy elements commonly have the form of an ellipsoid. A column extends upwards from each buoyancy element and these columns are interconnected by stiffening and reinforcing stays.

Such semi-submersible platforms are characterized in that a great part of the buoyancy will be situated relatively deep when the platform is in working condition and, furthermore, they are designated so as to provide a considerable hydrodynamic mass. At the same time, the surface breaking area of the platform and, consequently, the hydrostatic spring stiffness is comparatively low, so that the resonance period for heave, roll and pitch movements may be placed outside the wave excitation period range, i.e. usually above 20 seconds. The hydrodynamic forces acting on the submerged buoyancy elements and the forces acting on the surface braking columns, act in opposite directions so as to reduce the vertical wave force. The magnitude of this reduction of vertical forces is dependent on the the wave period, and completed cancellation of the potential pressure forces is obtained at a particular period. Consequently, two effects are inherent in the semi-submersible concept, namely no dynamic magnification due to wave excitaion at resonance, and deliberate use of wave cancellation for the potential pressure forces.

Said platform structures have in common that the buoyancy elements and the columns have such large cross-sectional dimensions that stiffeners, beams, bulkheads etc. must be used to brace the hull plates against the hydrostatic and hydrodynamic pressures pressures. This, of course, increases the weight and building cost of the structures. The length of the columns and the relatively large spacing between the buoyancy elements cause the columns to be subjected to high loads, particularly at the attachment points in the deck structure of the platfom. Furthermore, the dect structure must be made rigid and strong to take the corresponding large spans between the columns. This will also lead to increased weight, a circumstance which is further magnified due to the large safety margins which are necessary in platforms for offshore use.

Since the buoyancy elements are few and large, damage to one or more of these may easily bring the platform in a critical situation. Damage to strengthening stays may also be dangerous, and one has at least one example where the failure of such a stay has led to a serious wreck.

SUMMARY OF THE INVENTION

The object of the present invention is to provide a supporting buoyancy unit of the type mentioned by way of introduction, which does not suffer from the above drawbacks and deficiencies. Furthermore, it is the purpose of the invention to provide such a buoyancy unit which permits simplified construction and maintenance and which permits the use of lower safety factors even for considerably larger. platforms than the ones previously built.

This is obtained according to the invention by the buoyancy elements comprising a plurality of buoyancy bodies in the form of closed pipes having a diameter of less than about 5 meters and being arranged alongside each other, preferably with spacing therebetween, for forming a float-like unit.

This results in a considerable simplification of the manufacture of the buoyancy element, i.a. because the pipes to be used are commercially available in the desired material qualities. Furthermore, the curvature of the pipes and their slender form make them resist the hydrostatic and hydrodynamic pressure forces without any complicated and costly internal structure. Time consuming and difficult to control welding is reduced to a minimum, and the building time becomes considerably shorter, all resulting in lower cost.

Since the stress picture in the geometrically relatively simple pipe form is easy to calculate, the structural safety factors may be reduced without a reduction in safety. Furthermore, it will be easy to arrange for one or more of the pipes to be replaced in a buoyancy body if they for one reason or another should be damaged. Such replacement could easily take place without docking of the platform, and might even take place at the site of use if the conditions are favourable. Such replacement is simplified by the pipes according to the invention being attached through superimposed, transverse yokes, which preferably also constitute hollow buoyancy bodies. Upon releasing the pipe it may be ballasted so that it sinks down below the buoyancy body and can be removed by simple means. When a new pipe is to be brought in place, it may be provided with releasable weights as ballast, which may be removed when the pipe has been hauled in place.

In accordance with the invention, the upwardly extending supporting columns may advantageously be attached to the transverse yokes. this will provide the possibility of using a plurality of suppoting columns with a certain spacing instead of a larger central column, thus contributing to a more even distribution of the load, both on the yokes and in the deck structure. Between the supporting columns and at least some of the yokes, angled props may advantageously be arranged, preferably so that their horizontal projection is parallel to the pipes of the buoyancy body.

The invention also relates to a platform comprising a deck structure which at least partially is supported by columns extending upwards from a plurality of buoyancy units according to the invention, characterized in that the buoyancy units are substantially evenly distributed on the underside of the deck structure.

In turn this will provide even support of the deck, so that local weights on the deck are counteracted by buoyancy more or less directly below the weight. The fact that the distance between the action and the reacion points is short for the forces, gives large savings in the supporting structure of the deck as compared to conventional platform types where large deck spans are used.

The even distribution of the suppot makes it possible to build the deck much larger than what has previously been usual. Thus, deck structures of e.g. 200×200 m could be envisaged. For an ocean wave length of 200 m, which is in the upper range for the normal operating conditions, the vertical wave force will provide complete cancellation. This is a geometrical cancellation form which comes in addition to the previously mentioned cancellation of potential pressure forces. This effect is the strongest when the dimensions of the platform constitute multiples of the wave length, while for wave lengths in between, a partial cancellation will take place. This wave force cancellation of the geometrical type occurs also for the horizontal components of the wave force, which contributes to minimizing the horizontal movements of the platform.

A platform accoding to the inventio, with a large number of submerged pipes distributed over a large area, will not only benefit from wave force cancellation effects, but will also contribute to dampening the waves. The submerged pipes will distrub the circualr paths of the water particles in the waves so tha vortex formation occurs in the wave, which in turn requires energy and leads to a reduction in the kinematic energy and the potential energy in the waves.

This reduced wave activity has several beneficial effects. Firstly, a reduction of the wave height will improve the motion characteristics for those wave periods that provide only partial force cancellation. Secondly, the reduction of the largest wave heights makes it possible to place the platform deck lower with respect to the calm water level without danger of it being hit by the waves. This entails a reduction in required building height and as a result, reduced production cost, and reduced wind loading because the wind velocity is lower nearer the water surface. The third advantage in a platform with substantial wave dampening characteristics is that supply ships and the like may come alongside on the leeward side of the platform, even in rather bad weather, thus facilitating the provision of supplies considerably. These circumstances also open up the possibities of using high speed vessels for transport of personnel, which may assist in making the expensive helicoper transport used today superfluous.

It will be understood that the wave dampening properties of the buoyancy units to some extent will depend on the spacing between the pipe-like buoyancy bodies. This spacing should be about 0.25–2 times the diameter of the pipes, preferably 0.5–1 times the diameter.

Furthermore, it may be advantageous to place the buoyancy units so that the pipes in two adjacent units lie generally at right angles to each other. The wave dampening properties of the platform will thereby be about the same, regardless of the incoming direction of the waves.

If the desired dampening properties cannot be obtained without the pipe distance and diameter becoming excessively large, one may envision making each buoyancy unit with two or more layers of pipes, optionally with orthogonal orientation. The pipes may have a diameter of between 2 meters and 5 meters, preferably about 3 meters, and with a wall thickness of 40 millimeters. The length of the pipes is preferably equal to the desired width of the buoyancy unit so that it may be made quadratic without joining the pipes. Quadratic buoyancy units are practical when the pipes are to be arranged at an angle to each other in adjacent units, but it will be understood that any other suitable form will fall within the scope of the invention. The buoyancy units are preferably built such that the pipes will be lying horizontally, but it is not excluded that other ways of orienting the pipes may be more advantageous in particular applications.

The invention also relates to a method for making a platform of the type mentioned above, characterized in that its deck structure is assembled from sections built separetely, each being supported by at least one buoyancy unit. Thus, the different sections may be built concurrently at different, possibly smaller yards, so that building time and cost are reduced. It may also be advantageous to use the respective buoyancy units to carry the different sections when these are floated to the assembly place.

Further advantageous features of the invention will appear from the following description of the exemplifying embodiment of the invention shown schematically in the appended drawings.

DETAILED DESCRIPTION OF THE INVENTION

Figure 1:
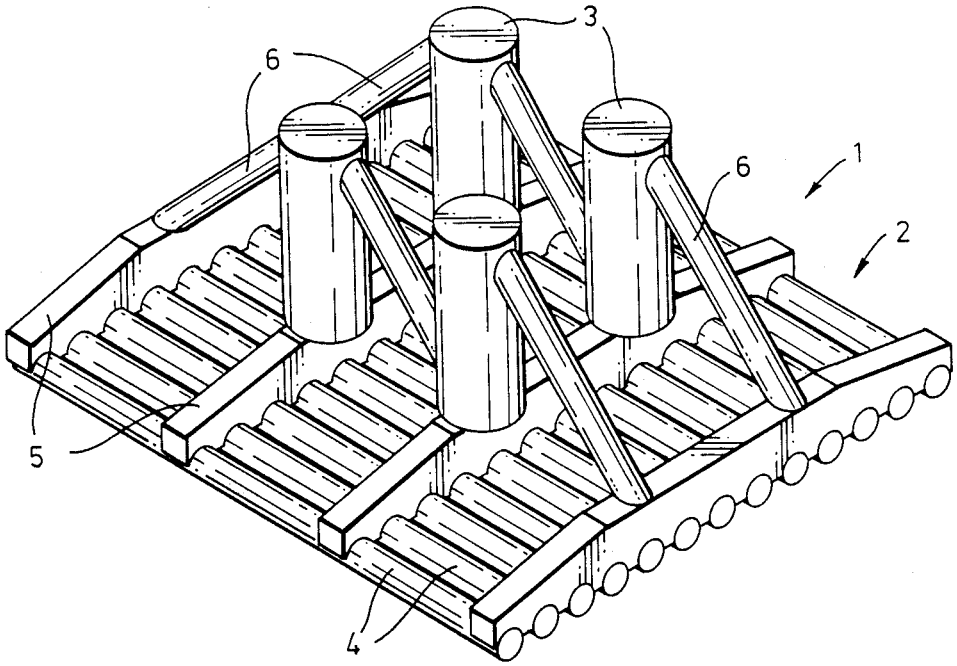
FIG. 1 shows perspectively an embodiment of a buoyancy unit according to the invention.

The buoyancy units are generally designated 1 in the drawings, and such a unit is shown in greater detail in FIG. 1. It comprises a float-like buoyancy element 2 and columns 3 extending upwards therefrom. The float 2 is comprised by a number of buoyancy bodies in the form of closed pipes 4, which rest in corresponding recesses in a plurality of inverted cribs or yokes 5. The column 3 rest on the two midmost yokes and are shored by stays 6 extending at an angle from the upper portion of the columns down to the yokes.

The pipes 4 are closed at the ends, in the simplest form by means of a welded plate. The edge of the pipe opening may optionally be provided with a reinforcement, e.g. a flange. However, the strains on the end plates are relatively minor, the size taken into consideration, so that it will not be necessary to use curved end plates, the result of which of course being simplifications and reduced cost. The pipes 4 are preferably provided with a manhole in order to provide access for inspection or the like. Preferably the pipes are also provided with the necessary valves or the like for ballasting and deballasting if it should be necessary to replace the pipe while the platform is at sea. For this purpose, the ends of the pipes may be provided with suitable means for the attachment of slings or releasable weights.

The inverted cribs or yokes 5 are preferably made as hollow bodies so that also these act as buoyancy bodies. The pipes 4 may be attached to the yokes 5 in any suitable manner. One such manner may be the use or clamps, which easily can be made so that they may be released by divers should it be necessary to replace one or more pipes while the platform is in use. Such clamps will also provide for a certain internal movement between the pipes and the yokes, so that large clamping forces are avoided between these means when elastic deformations take place due to e.g. wave forces. Here, one may contemplate clamping each pipe to one of the yokes 5, while a suitable antifriction material is placed between the pipes and the remaining yokes in order to permit smaller relative movements in the longitudinal direction of the pipe.

Figure 2:
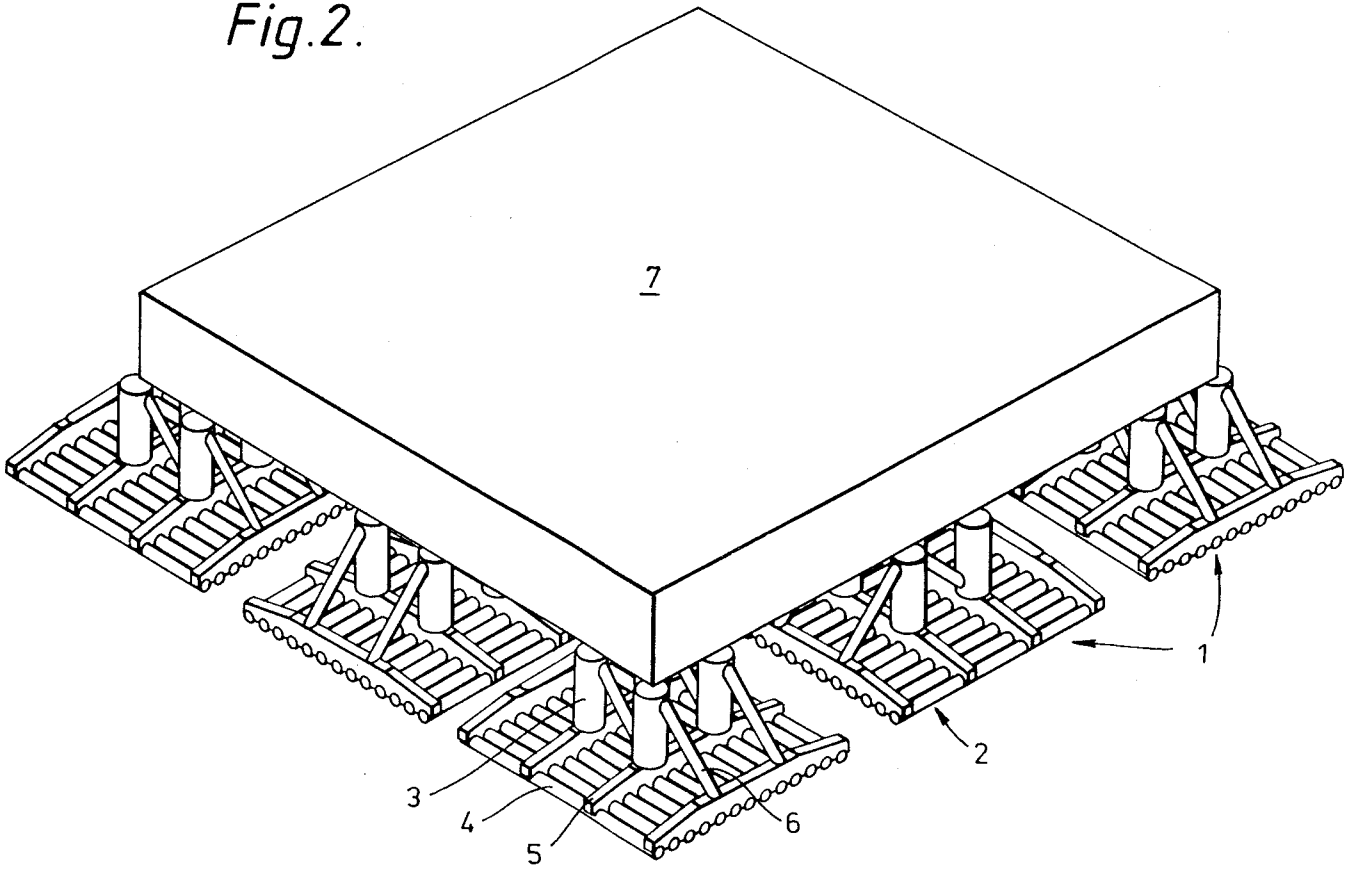
FIG. 2 shows perspectively a platform according to the invention.

FIG. 2 shows a platform with a schematically illustrated deck structure 7, where three buoyancy units 1 accoding to the invention are placed along each edge.

Figure 3:
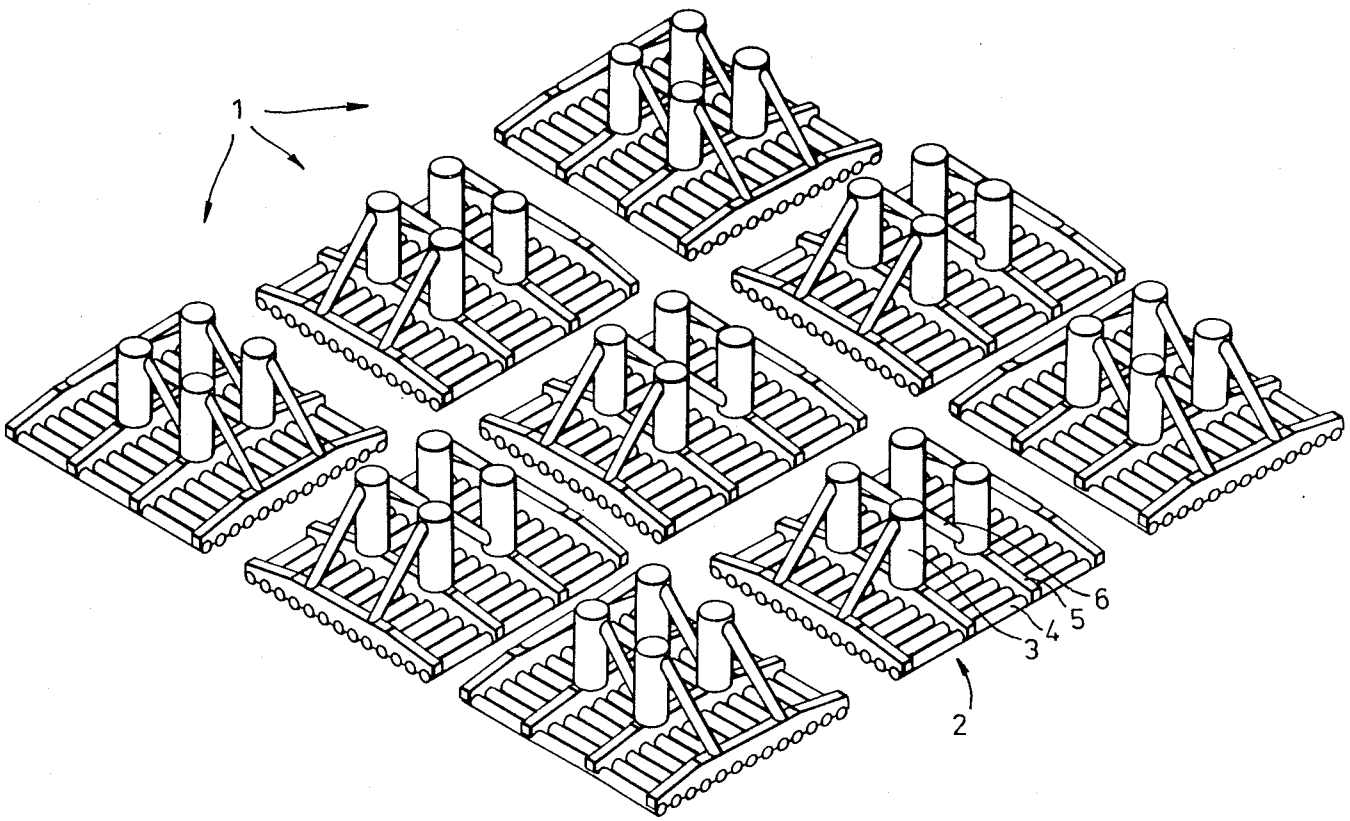
FIG. 3 illustrates the arrangement of the buoyancy elements for the platform in FIG. 2.

FIG. 3 shows all the buoyancy units of the platform, the platform structure having been deleted. It wil be seen that in the buoyancy units 1 arranged at the corners of the platform the pipes 4 all extend in the same direction. The remaining buoyancy units are turned 90° with respect to the corner units. As previously mentioned, this will contribute to the wave dampening characteristics of the platform being generally the same regardless of the incoming direciton of the waves. From FIG. 3 it will also be seen that the buoyancy unit in the middle has a somewhat different form, the pipes not being throughgoing but being deleted between the two midmost yokes. This is done to give room for lowering of e.g. riser pipes and other equipment for drilling and production of natural resources. In order to obtain such a central opening, one could, of course, have used an even number of buoyancy units, so that a central opening would have been formed naturally.

In FIG. 2 the deck structure 7 is shown resting with its edges on those of the columns 3 of the buoyancy units lying towards the outside. However, one could contemplate the deck structure being made with a certain overhang, e.g. so that its edges would be flush with the periphery of the outer buoyancy units.

It will be understood from the above that according to the invention, one has provided a buoyancy unit and a platform structure which utilize components which may be made in a simple and inexpensive manner. For instance, it will be possible to build the buoyancy units in a dock or on a bedding in non-specialized yards so that the cost remains low. The transportation to the place where the platform is to be assembled, can take place by means of e.g. towing or barge transportation. Building of the deck and mounting it on the buoyancy units may be performed in a number of ways. The deck may for instance be built in sections, each corresponding to a buoyancy unit. These sections may be more or less completed as regards production equipment. Thereafter, the sections may be mounted on top of their respective buoyancy units in a dock, by means of barges or a floating crane. These operations may be performed at different wordshops, and the different units may later be towed to a workshop to be joined to the final platform.

It will be understood that platforms according to the invention may be built having quit substantial dimensions. Unlike previously known platforms, where the square meter price for the platform deck itself has been so high that the production equipment have had to be packed quite closely, which has necessitated safety measures which in turn have lead to high cost, the deck of a platform according to the invention may more readily be constructed with regard to effective manufacturing and optimum safety, e.g. in order to give natural ventilation and simpler isolation of dangerous gas areas.

It will be understood that if the pipe-like buoyancy bodies according to the invention should be damaged, e.g. in a collision with a supply ship or drifting objects such as small icebergs, the buoyancy bodies may be replaced quit simply without taking the platform out of service. This may be envisioned in the following manner. The damaged pipe is filled with water, if this has not already been caused by the damage. Wire slings are attached to the ends of the damaged pipe in the previously mentioned attachment means and to suitable points at the outer edge of the buoyancy element. Clamps holding the pipe to the yokes are loosened by means of divers, and the pipe is permitted to sink freely so that it will move generally as a pendulum hanging in the slings. When the pipe has come to rest, it may be lifted onboard a crane vessel or the like. When mounting a new pipe, one first attaches remotely releasable weights to the pipe so that it just about sinks. By means of slings or other suitable means the pipe is guided or hauled in place and attached by means of clamps. Finally, the ballast weights are removed, e.g. in the same way as the damaged pipe.

From the above it will be clear that according to the invention it is provided a buoyancy unit and a platform which are considerably cheaper and simpler in manufacture than those previously known, and at the same time one is not subjected to the same limitations as before as regards the size of the platform. It will also be clear that the exemplifying embodiment described is not meant to limit the invention. On the contrary, the invention may be varied and modified in a number of ways within the scope of the following claims.

Thus, the distance between the pipe-like buoyancy bodies withing one and the same buoyancy element need not be constant but may vary, e.g. so that it is smaller in the middle portion of the buoyancy element than at it outer portions. Furthermore, the pipe diameter may vary within one and the same buoyancy element, e.g. in that the midmost pipes have a larger diameter than the outer pipes, so that the buoyancy forces will cause smaller bending moments in the yokes of the buoyancy elements. A suitable combination of varying pipe diameters and distances may also be utilized to give the buoyancy elements optimum wave dampening properties. Furthermore, it lies within the scope of the invention to place the pipe-like buoyancy bodies closely spaced if this should be expedient in particular applications. Likewise it will be understood that the buoyancy units according to the invention, practically speaking, may be placed without any spacing on the lower side of the platform deck.

We claim:

1. A platform comprising:

(a) a deck;

(b) a plurality of spaced-apart bouyant support units for supporting the deck, each of said support units comprising, (i) at least five substantially cylindrical floatable pipe means having a diameter of less than about 5 meters and liquid impervious ends, said pipe means arranged substantillay parallel to each other, wherein the edge to edge distance between adjacent pipe means is from 0.25 to to 2.0 times the diameter of the pipe means, (ii) means for maintaining said pipe means in spaced-apart relationship.

2. The platform of claim 1 wherein the length of the pipe means is greater than its diameter.

3. The platform of claim 2 wherein the means for maintaining the pipe means in spaced-apart relationsip comprises at least two yokes mounted transversely to said pipe means and having spaced-apart recesses for housing at least a portion of said spaced-apart pipe means.

4. The platform of claim 3 wherein two of said yokes are mounted on opposed ends of said spaced-apart pipe means.

5. The platform of claim 4 further comprising at least one columm, each column mounted on one of said yokes and extending upwardly from the yoke to provide a surface for supporting said platform.

6. The platform of claim 3 comprising a first pair of yokes mounted on opposed ends of said spaced-apart pipe means and a second pair of yokes mounted between said first pair of yokes and respective pairs of columns mounted on said second pair of yokes and extending upwardly from said yokes to provide respective surfaces for supporting said platform.

7. The platform of claim 5 further comprising at least one stay mounted on a yoke and extending to one of said columns.

8. The platform of claim 6 further comprising at least one stay mounted on a yoke and extending to a column mounted on another of said yokes.

9. The platform of claim 2 wherein the diameter of each pipe is 2 to 5 meters.

10. The platform of claim 2 wherein the edge to edge distance between adjacent pipe means is from 0.5 to 1.0 times the diameter of the pipe means.

11. The platform of claim 2 wherein the longitudinal axes of the pipe means of one support unit is perpendicular to the longitudinal axes of the pipe means of at least one adjacent support unit.

12. The platform of claim 2 wherein the area coverd by the spaced-apart support units is substantially the same as the area of the deck.

13. A bouyant support unit for supporting a platform in a liquid comprising:

(a) at least five substantially cylindrical floatable pipe means having a diameter of less thant about five meters and liquid-impervious ends, said pipe means being arranged substantially parallel to each other in spaced-apart relationship, wherein the edge to edge distance between adjacent pipe means is from 0.25 to 2.0 times the diameter of the pipe means; and (b) means for maintaining said pipe means in spaced-apart relationship.

14. The supporting unit of claim 13 wherein the length of the pipe means is greater than its diameter.

15. The support unit of claim 13 wherein the means for maintaining the pipe means in spaced-apart relationship comprises at least two yokes mounted transversely to said pipe means and having spaced-apart recesses for housing at least a portion of said spaced-apart pipe means.

16. The support unit of claim 15 wherein two of said yokes are mounted on opposed ends of said spaced-apart pipe means.

17. The support unit of claim 16 further comprising at least one column, each column mounted on one of said yokes and extending upwardly from the yoke to provide a surface for supporting said platform.

18. The support unit of claim 15 comprising a first pair of yokes mounted on opposed ends of said spaced-apart pipe means and a second pair of yokes mounted between said first pair of yokes, and respective pairs of columns mounted on said second pair of yokes and extending upwardly from said yokes to provide respective surfaces for supporting said platform.

19. The support unit of claim 17 further comprising at least one stay mounted on a yoke and extending to one of said columns.

20. The support unit of claim 19 further comprising at least one stay mounted on a yoke and extending to a column mounted on another of said yokes.

21. The support unit of claim 13 wherein the edge to edge distance between adjacent pipe means is from 0.5 to 1.0 times the diameter of the pipe means.

22. The support unit of claim 13 wherein the diameter of each pipe means is 2 to 5 meters.

* * * * *